US010982833B2

(12) United States Patent
Iwasaki et al.

(10) Patent No.: US 10,982,833 B2
(45) Date of Patent: Apr. 20, 2021

(54) VEHICLE LAMP

(71) Applicant: Ichikoh Industries, Ltd., Isehara (JP)

(72) Inventors: Kazunori Iwasaki, Isehara (JP); Yasuhiro Okubo, Isehara (JP); Takanori Hamamoto, Isehara (JP); Yosuke Omori, Isehara (JP)

(73) Assignee: Ichikoh Industries, Ltd., Isehara (JP)

( * ) Notice: Subject to any disclaimer, the term of this patent is extended or adjusted under 35 U.S.C. 154(b) by 0 days.

(21) Appl. No.: 16/757,046

(22) PCT Filed: Oct. 11, 2018

(86) PCT No.: PCT/JP2018/037862
§ 371 (c)(1),
(2) Date: Apr. 17, 2020

(87) PCT Pub. No.: WO2019/087727
PCT Pub. Date: May 9, 2019

(65) Prior Publication Data

US 2020/0248884 A1 Aug. 6, 2020

(30) Foreign Application Priority Data

Oct. 30, 2017 (JP) ..... JP2017-209581

(51) Int. Cl.
*F21S 41/275* (2018.01)
*F21S 41/663* (2018.01)
(Continued)

(52) U.S. Cl.
CPC ..... *F21S 41/275* (2018.01); *F21S 41/148* (2018.01); *F21S 41/40* (2018.01); *F21S 41/663* (2018.01);
(Continued)

(58) Field of Classification Search
CPC ..... F21S 41/663; F21S 41/148; F21S 41/40
See application file for complete search history.

(56) References Cited

U.S. PATENT DOCUMENTS 5,036,438 A 7/1991 Nakata
2006/0120094 A1* 6/2006 Tsukamoto ..... F21S 41/663 362/518
(Continued)

FOREIGN PATENT DOCUMENTS

JP 2-260301 A 10/1990
JP 2012-226860 A 11/2012
(Continued)

OTHER PUBLICATIONS

International Search Report dated Dec. 11, 1018 in PCT/JP2018/037862 filed on Oct. 11, 2018, 2 pages.

*Primary Examiner* — Alexander K Garlen
(74) *Attorney, Agent, or Firm* — Oblon, McClelland, Maier & Neustadt, L.L.P.

(57) ABSTRACT

The vehicle lamp of the present invention includes: a first light source that emits light for low-beam light distribution; a lens arranged in a front side of the first light source; a shade that is arranged between the first light source and the lens and forms a cut-off line of a low-beam light distribution pattern; a reflector that reflects light from the first light source towards the lens; and a second light source that is arranged between the first light source and the lens and emits light for high-beam additional light distribution. A rear focal point of the lens is located more to a front side than a second focal point which is a focal point on a front side of the reflector, and a lens optical axis of the lens is inclined forward and obliquely downward with respect to a lamp optical axis of the lamp.

7 Claims, 9 Drawing Sheets

(51) Int. Cl.

| | |
|---|---|
| ***F21S 41/148*** | (2018.01) |
| ***F21S 41/40*** | (2018.01) |
| ***F21S 41/16*** | (2018.01) |
| ***F21W 102/135*** | (2018.01) |
| ***F21S 45/48*** | (2018.01) |

(52) U.S. Cl.
CPC ..... *F21S 45/48* (2018.01); *F21S 41/16* (2018.01); *F21W 2102/135* (2018.01)

(56) References Cited

U.S. PATENT DOCUMENTS

2012/0262935 A1* 10/2012 Yamamoto ..... F21S 41/147 362/516
2013/0107564 A1* 5/2013 Yatsuda ..... F21S 41/321 362/543
2014/0233252 A1* 8/2014 Shibata ..... F21S 41/683 362/512
2015/0146446 A1* 5/2015 Barta ..... F21S 41/365 362/516
2015/0219301 A1* 8/2015 Honda ..... F21S 41/147 362/517
2016/0305628 A1* 10/2016 Lin ..... F21S 41/36
2017/0227184 A1* 8/2017 Ishida ..... F21S 41/365
2017/0299137 A1* 10/2017 Kinoshita ..... F21S 41/365
2018/0224112 A1* 8/2018 Wang ..... F21S 41/17
2018/0272925 A1* 9/2018 Wang ..... F21S 41/689
2018/0363874 A1* 12/2018 Kawai ..... F21S 45/47
2018/0372294 A1* 12/2018 Inoue ..... F21S 41/151

FOREIGN PATENT DOCUMENTS

JP 2013-30372 A 2/2013
JP 2014-157710 A 8/2014
WO WO 2017/104678 A1 6/2017

* cited by examiner (A)

(B)

(C)

(A)

(B)

(C)

(A)

(B)

(C)

(A)

(B)

(C)

VEHICLE LAMP

TECHNICAL FIELD

The present invention relates to a vehicle lamp.

BACKGROUND ART

Patent Literature 1 discloses a vehicular light (hereinafter, also referred to as a vehicle lamp) configured to be able to selectively perform a low-beam irradiation and a high-beam irradiation. The vehicular light includes a projection lens, a first light source that is located behind the projection lens and emits light that forms a light distribution pattern for low beam, a second light source that is located behind the projection lens and emits light that forms an additional light distribution pattern for high beam, and a shade that is located behind the projection lens and forms a cut-off line of the light distribution pattern for low beam. The vehicular light has an optical path converter that converts a part of the light emitted from the second light source in such a manner that the light travels between the light distribution pattern for low beam and the additional light distribution pattern for high beam.

For example, in Patent Literature 1, the optical path converter is formed on the upper light emission surface in an area above the lens optical axis of the projection lens. Specifically, as illustrated in FIG. 2 of Patent Literature 1, the optical path converter is formed with the upper and outer light emission surface of the projection lens as a curvature change processing surface that the upper light emission surface is curved towards behind greater (reducing the radius of curvature of the light emission surface) than the lower light emission surface in the area below the lens optical axis is.

Then, since such an optical path converter has a rear focal point located below the basic rear focal point (a rear focal point in an area other than the curvature change processing surface) of the projection lens, the light incident on the optical path converter is emitted so as to travel slightly downward. As a result, part of the light of the second light source emitted forward from the optical path converter travels towards between the light distribution pattern for low beam and the additional light distribution pattern for high beam.

CITATION LIST

Patent Literature

PTL 1; WO 2017/104678

SUMMARY OF THE INVENTION

Problems to be Solved by the Invention

As described above, when the upper and outer light emission surface of the projection lens (hereinafter simply referred to as a lens) is used as the optical path converter and the rear focal point is largely deviated from the basic rear focal point of the projection lens, it is considered that the design is such that the radius of curvature of the light emission surface as the optical path converter is finely changed.

However, if the radius of curvature is finely changed in this manner, the surface shape becomes distorted, and thus, not only the design may be degraded, but also the light distribution pattern that is projected changes finely, and therefore, a stripe due to a difference in luminosity is likely to appear in the vertical direction.

The present invention has been made in view of such circumstances, and it is an object of the present invention to provide a vehicle lamp in which the surface shape of the light emission surface of lens is less distorted and by which a stripe due to a difference in luminosity hardly appears.

Means for Solving the Problem

The present invention is grasped by the following configurations to achieve the above object. (1) A vehicle lamp according to the present invention includes: a first light source that emits light for low-beam light distribution; a lens arranged in a front side of the first light source; a shade that is arranged between the first light source and the lens and forms a cut-off line of a low-beam light distribution pattern; a reflector that reflects light from the first light source towards the lens; and a second light source that is arranged between the first light source and the lens and emits light for high-beam additional light distribution. A rear focal point of the lens is located more to a front side than a second focal point which is a focal point on a front side of the reflector, and a lens optical axis of the lens is inclined forward and obliquely downward with respect to a lamp optical axis of the lamp.

(2) In the configuration of (1) above, in a virtual state where the lens is provided in such a manner that the lens optical axis coincides with the lamp optical axis, the lens performs light distribution control by which a virtual cut-off line of a virtual light distribution pattern formed by the light from the first light source is located above the cut-off line of the low-beam light distribution pattern.

(3) In the configuration of (1) or (2) above, an inclination of the lens optical axis is such that the lens optical axis is rotated and inclined with the rear focal point of the lens as a rotation axis.

(4) In any one of the configurations (1) to (3) above, further includes a heat sink and a lens holder that attaches the lens to the heat sink, wherein the heat sink includes: a first base section on which the first light source is arranged; and a second base section which is located on a front side of the first base section and is inclined forward and obliquely downward, and on which the second light source is arranged. The second light source includes a plurality of second light emitting chips that are arranged in a horizontal direction. The shade includes: a light shielding section that is located above the second light emitting chips and forms the cut-off line of the low-beam light distribution pattern; and a pair of arm sections provided at both ends of the light shielding section and fixed to the heat sink.

(5) In the configuration of (4) above, further includes a reflection member that is arranged below the second light emitting chips and reflects, toward the lens, light from the second light source which is a member separate from the shade.

(6) In the configuration of (4) or (5) above, the lens includes a flange section to be fixed to the lens holder, and at least one of the lens holder and the flange section is configured to incline the lens optical axis forward and obliquely downward with respect to the lamp optical axis.

(7) In any one of the configurations (1) to (5) above, at least one of an incident surface and a light emission surface of the lens is configured to have a shape to incline the lens optical axis forward and obliquely downward with respect to the lamp optical axis.

Effect of the Invention

According to this invention, a vehicle lamp in which the surface shape of the light emission surface of lens is less distorted and by which a stripe due to a difference in luminosity hardly appears can be provided.

MODE FOR CARRYING OUT THE INVENTION

Figure 1:
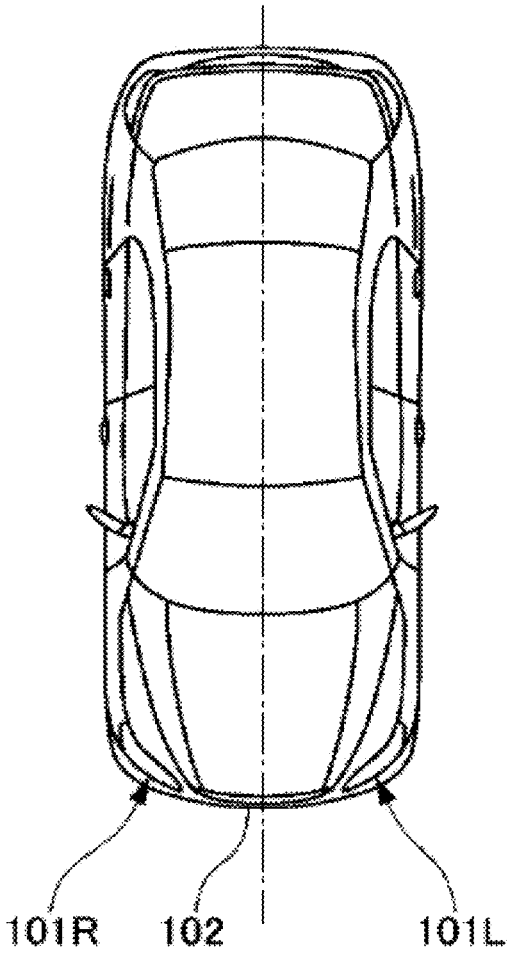
FIG. 1 is a plan view of a vehicle provided with a vehicle lamp of an embodiment according to the present invention.

Hereinafter, an embodiment for carrying out the present invention (hereinafter, referred to as an "embodiment") will be described in detail with reference to the accompanying drawings.

The same elements are denoted by the same reference numerals or signs throughout the description of the embodiment.

In addition, in the embodiment and drawings, unless otherwise specified, "front" and "rear" indicate "forward direction" and "rearward direction" of a vehicle, respectively, and "up", "down", "left", and "right" indicate a direction as seen from a driver in the vehicle, respectively. Needless to say, the "up" and "down" are also "up" and "down" in a vertical direction, and the "left" and "right" are "left" and "right" in a horizontal direction.

FIG. 1 is a plan view of a vehicle 102 provided with a vehicle lamp of an embodiment according to the present invention.

As illustrated in FIG. 1, the vehicle lamp of the embodiment according to the present invention is a vehicle head lamp (101L, 101R) provided on each of the right and left in front of the vehicle 102, and is hereinafter simply referred to as a vehicle lamp or a lamp.

The vehicle lamp of this embodiment includes a housing (not illustrated) opened to the front side of the vehicle and an outer lens (not illustrated) attached to the housing so as to cover an opening. A lamp unit 1 (see FIG. 2) and the like are arranged in a lamp room formed by the housing and the outer lens.

Figure 2:
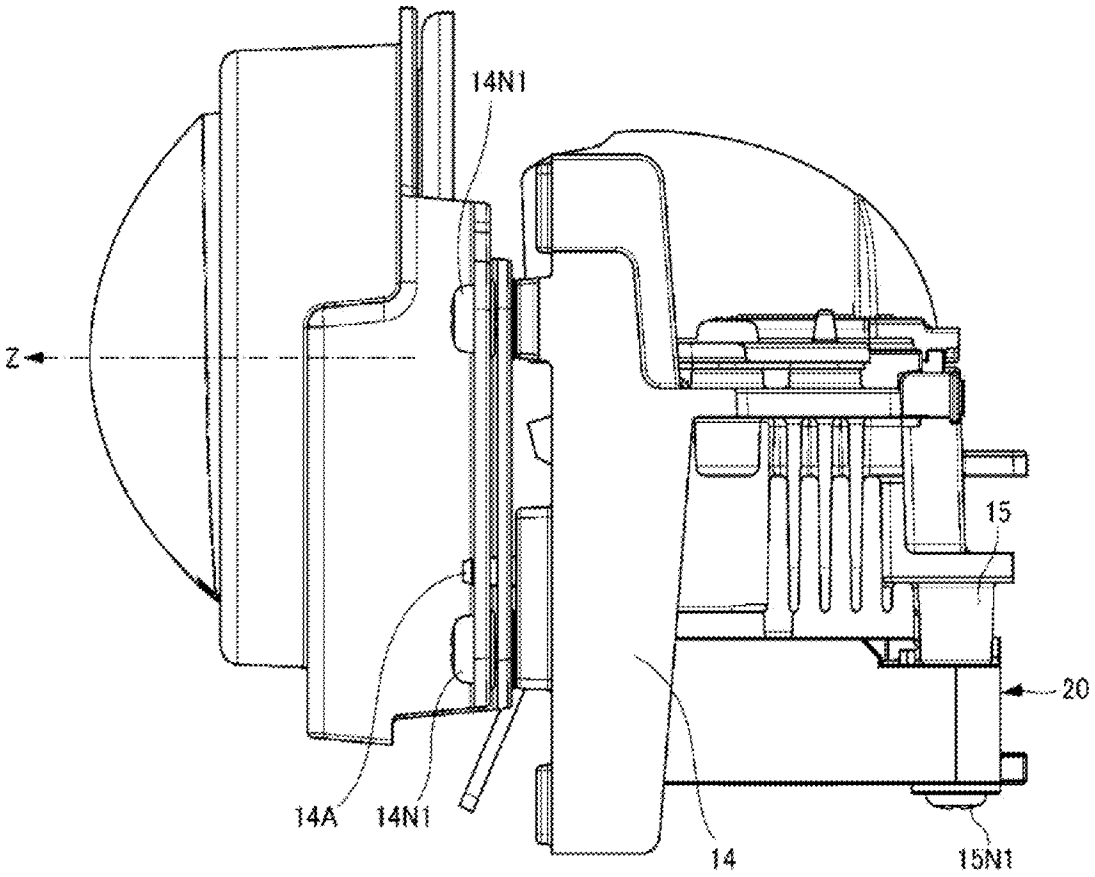
FIG. 2 is a side view of a lamp unit of the embodiment according to the present invention.
Figure 3:
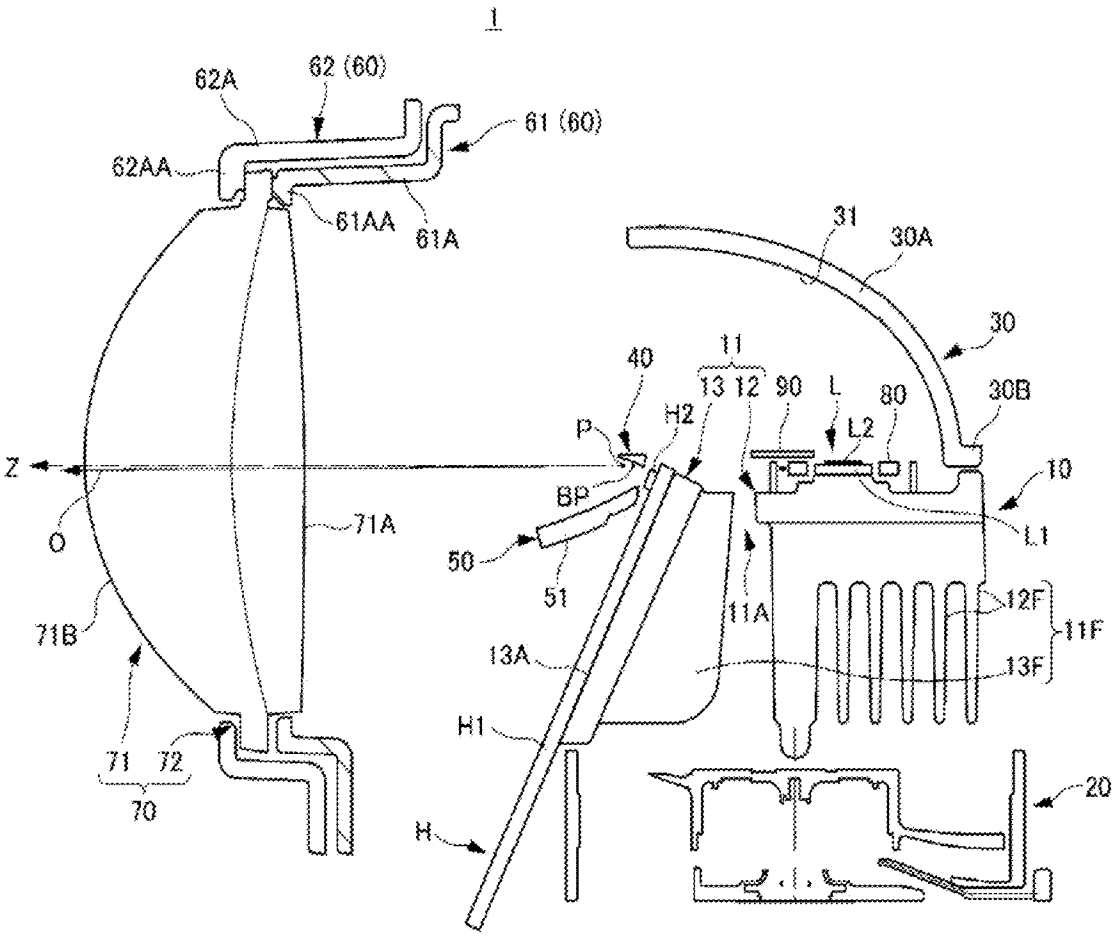
FIG. 3 is a cross-sectional view of the lamp unit of the embodiment according to the present invention.

FIG. 2 is a side view of the lamp unit 1, and FIG. 3 is a cross-sectional view of the lamp unit 1 along a lamp unit optical axis (hereinafter, also referred to as a lamp optical axis Z) illustrated in FIG. 2.

Figure 4:
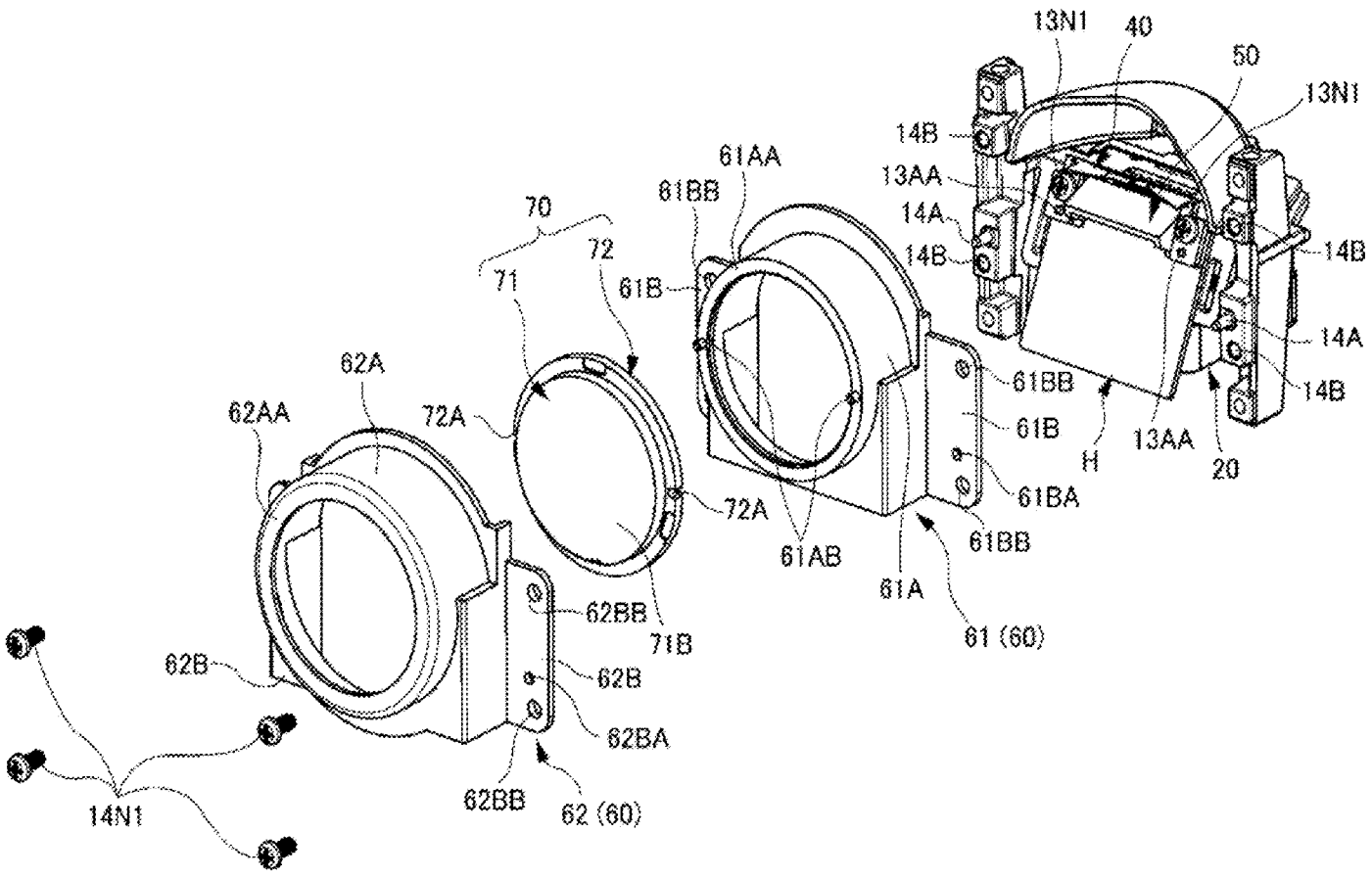
FIG. 4 is a partially exploded perspective view of the lamp unit of the embodiment according to the present invention.
Figure 5:
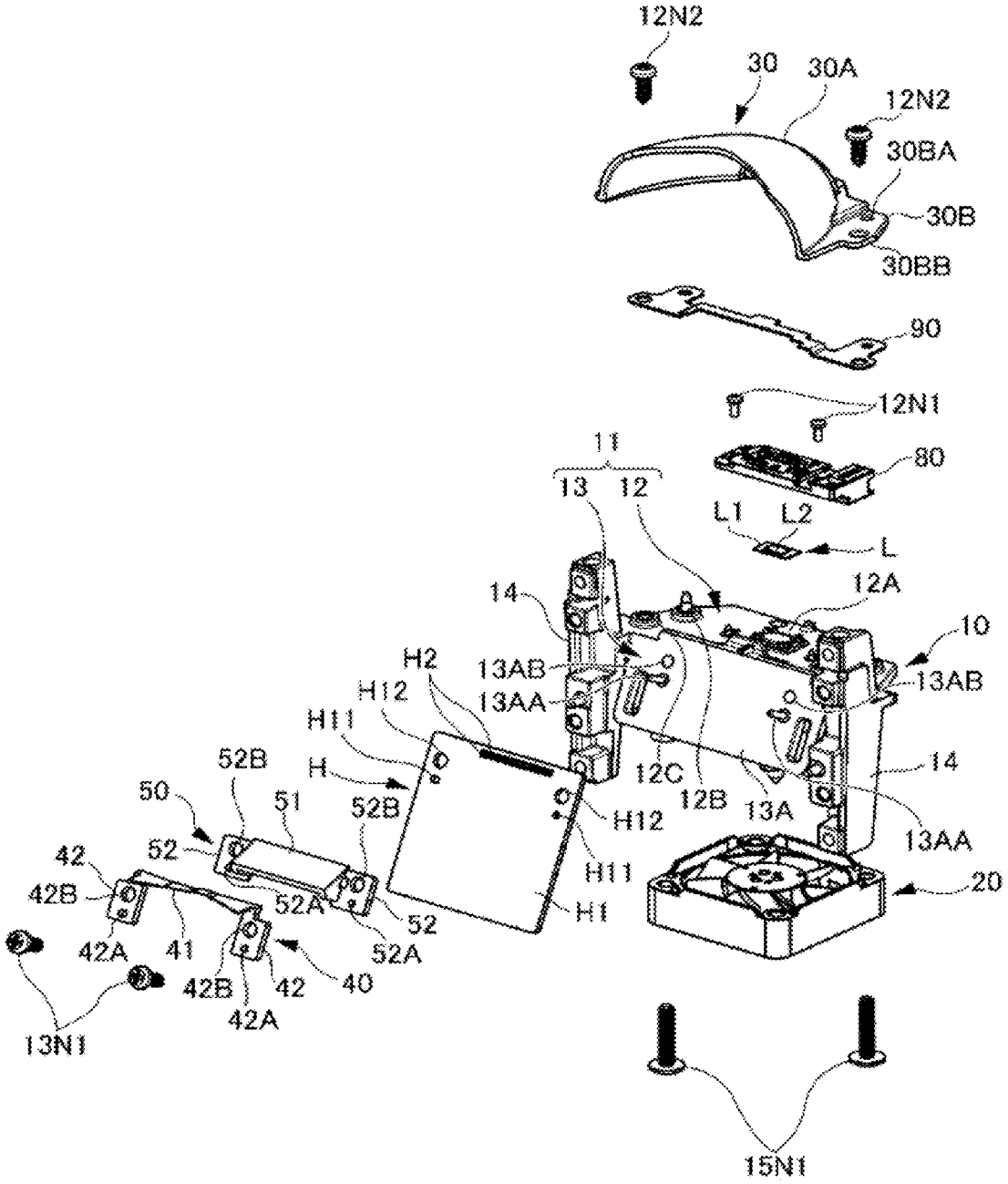
FIG. 5 is an exploded perspective view of a part excluding a lens and a lens holder of the lamp unit of the embodiment according to the present invention.

In addition, FIG. 4 is a partially exploded perspective view of the lamp unit 1, and FIG. 5 is an exploded perspective view of a part excluding a lens 70 and a lens holder 60 of the lamp unit 1.

As illustrated in FIGS. 3 and 5, the lamp unit 1 mainly includes a heat sink 10, a cooling fan 20, a first light source L, a reflector 30, a shade 40, a second light source H, a reflection member 50, the lens holder 60, and the lens 70.

(Heat Sink 10)

The heat sink 10 is formed of a metal or a resin having a high thermal conductivity in order to efficiently dissipate the heat generated by the first light source L and the second light source H. In this embodiment, the heat sink 10 is an aluminum die-cast heat sink 10 in which respective parts to be described later of the heat sink 10 are integrally molded. However, as in this embodiment, the present invention need not be limited to the heat sink 10 of an integrally molded product, and a heat sink 10 a part of which is made of a separate part and assembled may be used.

The heat sink 10 includes a base section 11 including a first base section 12 on which the first light source L is arranged and a second base section 13 which is located on the front side of the first base section 12 and below the first base section 12 and is inclined forward and obliquely downward, and on which the second light source H is arranged.

As illustrated in FIG. 5, the first base section 12 is integrally formed on the upper surface and includes a first light source arrangement section 12A for arranging the first light source L. Then, the first light source L arranged in the first light source arrangement section 12A is fixed to the first light source arrangement section 12A by a light source holder 80 fixed to the first base section 12 with a pair of screws 12N1.

Meanwhile, the second base section 13 receives the second light source H on a front surface facing the front side, and is a second light source arrangement section 13A for arranging the second light source H.

A pair of right and left positioning pins 13AA are formed on the second light source arrangement section 13A so as to protrude forward, and a pair of right and left screw fixing holes 13AB are formed slightly above the positioning pins 13AA.

Then, as described later, the second light source H, shade 40, and reflection member 50 each include a pair of positioning pin insertion holes (positioning pin insertion holes H11, positioning pin insertion holes 42A, and positioning pins insertion holes 52A) corresponding to the positioning pins 13AA) and a pair of screw insertion holes (screw insertion holes H12, screw insertion holes 42B, and screw insertion holes 52B) corresponding to the screw fixing holes 13AB, and the second light source H, shade 40, and reflection member 50 are fixed together to the second base section 13 with screws 13N1, as illustrated in FIG. 4.

In addition, as illustrated in FIG. 3, the heat sink 10 includes a plurality of heat dissipation fins 11F provided integrally with the base section 11 below the base section 11. Specifically, the heat dissipation fins 11F include a plurality of first heat dissipation fins 12F that extend downward from the first base section 12 and are provided integrally with the first base section 12 and arranged in a front-rear direction, and a plurality of second heat dissipation fins 13F that extend rearward from the second base section 13 and are provided integrally with the second base section 13 and are arranged in a horizontal direction.

The first heat dissipation fin 12F has a thin plate shape, and is formed in such a manner that the thin plate-shaped surface faces in the front-rear direction. The wind sent between the first heat dissipation fins 12F from the cooling fan 20 flows in the horizontal direction.

In recent years, in order to reduce the size of vehicle lamps, the inner wall surface on the rear side of the lamp room in which the lamp unit 1 is arranged tends to be located near the rear of the lamp unit 1. In this case, if the wind is directed to the rear side, the flow of the wind may be worsened by the inner wall surface on the rear side of the lamp room located near the rear of the lamp unit 1 and the cooling efficiency may be reduced. However, if the wind is caused to flow in the horizontal direction as in this embodiment, such a reduction in cooling efficiency can be avoided.

Meanwhile, the second heat dissipation fin 13F has a thin plate shape, and is formed in such a manner that the thin plate-shaped surface faces in the right-left direction (horizontal direction), and the wind sent from the cooling fan 20 flows upward along the second base section 13. Then, a horizontally elongated opening 11A that opens in the vertical direction is formed between the first base section 12 and the second base section 13 so as not to obstruct the flow of the wind.

Therefore, as illustrated in FIG. 5, it is possible to avoid a reduction in cooling efficiency due to the influence of a pair of lens holder mounting sections 14 or the like that are provided on the right and left outer sides of the second base section 13 to mount the lens holder 60.

In addition, the wind takes heat while flowing along the second base section 13 and its temperature rises. Thus, by allowing the wind to flow upward rather than in the right-left direction, the flow will be better and the cooling efficiency can be enhanced.

Furthermore, the wind flows into the reflector 30 side through the opening 11A and contributes to the cooling of the space between the first base section 12 and the reflector 30, and thus the cooling efficiency of the first light source L can be further enhanced.

As mentioned earlier, the heat sink 10 includes the pair of lens holder mounting sections 14 (see FIGS. 4 and 5) provided on the right and left outer sides of the second base section 13. The lens holder mounting sections 14 each include a positioning pin 14A and a pair of screw fixing holes 14B provided vertically above and below the positioning pin 14A.

Then, as will be described later, the lens holder 60 includes positioning pin insertion holes (positioning pin insertion holes 61BA and positioning pin insertion holes 62BA) corresponding to the positioning pin 14A and screw insertion holes (screw insertion holes 61BB and screw insertion holes 62BB) corresponding to the screw fixing holes 14B, and is fixed to the lens holder mounting section 14 with screws 14N1 as illustrated in FIG. 2.

As illustrated in FIG. 2, the heat sink 10 includes a cooling fan mounting leg 15 formed with a screw fixing hole that opens downward, and the cooling fan 20 is mounted to the cooling fan mounting leg 15 with a screw 15N1.

(Cooling Fan 20)

The cooling fan 20 is arranged below the heat dissipation fins 11F of the heat sink 10 as illustrated in FIG. 3, and is fixed to the cooling fan mounting leg 15 of the heat sink 10 by the screw 15N1 as described above.

Then, by driving the cooling fan 20, wind is sent between the plurality of heat dissipation fins 11F, and the cooling efficiency by the heat sink 10 is enhanced, and the first light source L and the second light source H can be efficiently cooled.

(First Light Source L)

The first light source L is a light source that emits light for low-beam light distribution, and includes a substrate L1 and one first light emitting chip L2 provided on the substrate L1. The number of the first light emitting chip L2 need not be limited to one, and a plurality of first light emitting chips L2 (for example, four chips) may be provided on the substrate L1.

Then, the first light source L is arranged on the first base section 12 so as to emit light upward, and the emitted light is reflected towards the lens 70 by a reflection surface 31 of the reflector 30 facing the first light source L side.

In this embodiment, for the first light source L, an LED light source in which the first light emitting chip L2 is an LED chip is used. However, a laser light source in which the first light emitting chip L2 is an LD chip (laser diode chip) may be used, and a semiconductor light source is preferably used for the first light source L.

(Reflector 30)

As illustrated in FIG. 5, the reflector 30 includes a reflection section 30A having a reflection surface 31 that reflects light from the first light source L towards the lens 70 and a flange section 30B provided on an outer periphery of a lower end of the reflection section 30A.

Then, on the first base section 12, a pair of right and left positioning pins 12B for positioning the reflector 30 and a pair of right and left screw fixing holes 12C for fixing a pair of screws 12N2 for fixing the reflector 30 are provided. The flange section 30B of the reflector 30 includes a pair of right and left pin insertion holes 30BA corresponding to the positioning pins 12B and a pair of right and left screw insertion holes 30BB corresponding to the screw fixing holes 12C.

Therefore, after arranging the reflector 30 on the first base section 12 in such a manner that the reflector 30 is positioned by the positioning pins 12B, the screws 12N2 are screwed into the screw fixing holes 12C, and the reflector 30 thereby can be fixed to the first base section 12.

As illustrated in FIG. 3, the reflector 30 fixed in this manner is in a state where the front side is opened and the first light source L is covered in a half-dome shape, and the light from the first light source L is irradiated to the lens 70 through an opening on the front side.

In this embodiment, a plate member 90 that shields the vicinity of the front side of the first light source L from light is included, and the plate member 90 is fixed to the first base section 12 together with the reflector 30. In addition, the reflection surface 31 of the reflector 30 has an elliptical surface having two focal points, and the reflector 30 is arranged above the first base section 12 in such a manner that a first focal point (also referred to as a first focal point on the rear side of the reflector 30) of the reflection surface 31, which is the focal point on the rear side, substantially coincides with the emission center of the first light emitting chips L2 of the first light source L, and a second focal point BP (also referred to as a second focal point BP on the front side of the reflector 30) of the reflection surface 31, which is the focal point on the front side, is within a range overlapping with the shade 40 when viewed in the front-rear direction and is located below the shade 40.

(Shade 40)

Figure 8:
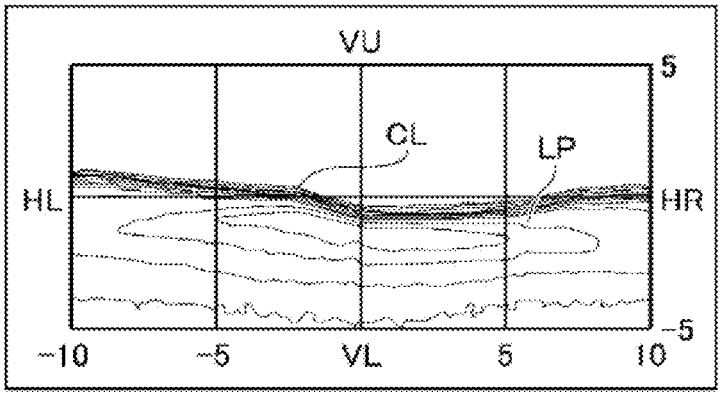
FIG. 8 are graphs illustrating a light distribution pattern when the lens optical axis of the lens is rotated downward with the use of the rear focal point of the lens of the embodiment according to the present invention as a rotation axis.
Figure 8:
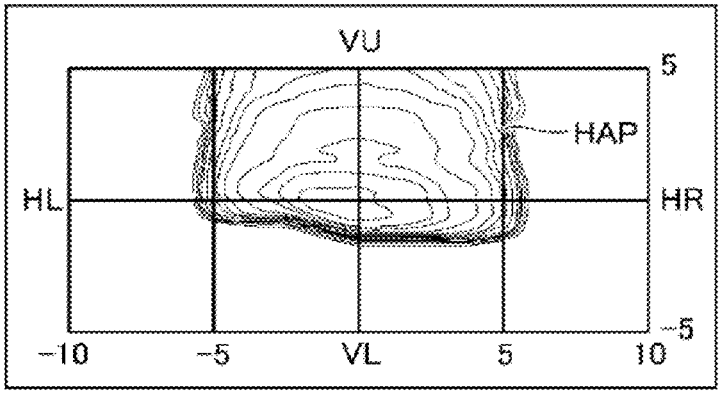
Figure 8:
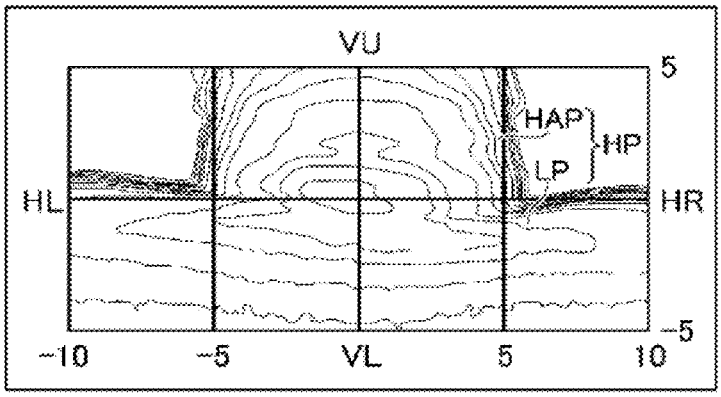

The shade 40 is a member for shielding part of the light from the first light source L reflected by the reflector 30 toward the lens 70, which goes to the lower side of the lens 70, and for forming a cut-off line (see FIG. 8) of a low-beam light distribution pattern LP (see FIG. 8).

Therefore, as illustrated in FIG. 5, the shade 40 has a shape corresponding to the shape of the cut-off line CL (see FIG. 8), and is located above the second light emitting chips H2 of the second light source H described later, and includes a light shielding section 41 that forms the cut-off line CL (see FIG. 8).

In addition, the shade 40 is integrally provided at each of the right and left ends (that is, both ends) of the light shielding section 41, and includes a pair of arm sections 42 for fixing to the heat sink 10 (more specifically, the second base section 13).

Then, in each of the pair of right and left arm sections 42, a positioning pin insertion hole 42A corresponding to the positioning pin 13AA of the second light source arrangement section 13A of the second base section 13 and a screw insertion hole 42B corresponding to the screw fixing hole 13AB of the second light source arrangement section 13A of the second base section 13 are formed, and as described above, the arm sections 42 can be fixed to the second base section 13 with the screws 13N1.

(Second Light Source H)

As illustrated in FIG. 5, the second light source H includes a substrate H1 and a plurality of second light emitting chips H2 that are provided on the substrate H1 and arranged in a horizontal direction.

Then, when a high-beam light distribution pattern HP (see FIG. 8) is to be obtained, the high-beam additional light distribution HAP (see FIG. 8) formed by the light from the second light source H is added above the low-beam light distribution pattern LP (see FIG. 8), and the high-beam light distribution pattern HP (see FIG. 8) is thereby formed.

Therefore, by turning on or off a part or all of the second light emitting chips H2, a variable high beam (Adaptive Driving Beam) control that changes the high-beam light distribution pattern HP (more specifically, the state of the high-beam additional light distribution HAP) can be performed so as to suppress the glare for oncoming and preceding vehicles.

In this embodiment, the second light source H is also an LED light source using an LED chip for the second light emitting chip H2, as is the case with the first light source L.

However, in the same manner as described for the first light source L, the second light emitting chip H2 may be a laser light source such as an LD chip (laser diode chip), and a semiconductor light source is preferably used for the second light source H.

Then, in the substrate H1, a pair of right and left positioning pin insertion holes H11 corresponding to the positioning pins 13AA of the second light source arrangement section 13A of the second base section 13 and a pair of right and left screw insertion holes H12 corresponding to the screw fixing holes 13AB of the second light source arrangement section 13A of the second base section 13 are formed, and the substrate H1 can be fixed to the second base section 13 with the screws 13N1 as described above.

(Reflection Member 50)

The reflection member 50 is a member that is arranged below the second light emitting chips H2 and reflects part of the light from the second light emitting chips H2 toward the upper side of the lens 70, and includes a reflection section 51 that reflects the light from the second light source H (the second light emitting chips H2) toward the lens 70, and fixing sections 52 that are provided integrally on the right and left of the reflection section 51 and are for fixing to the second base section 13.

Then, the light incident on the lower side of the lens 70 is reflected by the reflection section 51 to the upper side of the lens 70, and the high-beam additional light distribution HAP formed by the light from the second light source H (the second light emitting chips H2) thereby becomes a light distribution that spreads upward.

In addition, in each of the pair of right and left fixing sections 52, a positioning pin insertion hole 52A corresponding to the positioning pin 13AA of the second light source arrangement section 13A of the second base section 13 and a screw insertion hole 52B corresponding to the screw fixing hole 13AB of the second light source arrangement section 13A of the second base section 13 are formed, and the fixing sections 52 can be fixed to the second base section 13 with the screws 13N1 as described above.

(Lens Holder 60)

As illustrated in FIGS. 3 and 4, the lens holder 60 includes a first holder 61 that receives the rear side of the lens 70 (more specifically, a flange section 72) described later and a second holder 62 that presses the lens 70 (more specifically, the flange section 72) from the front side of the lens 70 (more specifically, the flange section 72) toward the first holder 61 side.

The first holder 61 includes a first holder main body 61A, of which periphery of the opening corresponding to an incident surface 71A is a receiving section 61AA that receives the rear side of the flange section 72 of the lens 70, and the first holder 61 includes the first holder main body 61A that is formed in such a manner that the lens 70 is located at a predetermined position on the front side when the first holder 61 is attached to the heat sink 10 and a pair of right and left first mounting sections 61B that is integrally provided on the rear side of the first holder main body 61A and is for fixing to the pair of lens holder mounting sections 14 of the heat sink 10.

In addition, the receiving section 61AA is provided with a pair of right and left positioning protrusions 61AB that engage with a pair of right and left positioning recesses 72A of the lens 70.

Meanwhile, the second holder 62 of which periphery of the opening corresponding to a light emission surface 71B is a pressing section 62AA that presses the flange section 72 of the lens 70 toward the receiving section 61AA side of the first holder 6, and the second main holder 62 includes a second holder body 62A that forms the exterior of the first holder body 61A of the first holder 61, and a pair of right and left second mounting sections 62B for fixing to the pair of lens holder mounting sections 14 of the heat sink 10.

Then, the pair of right and left first mounting sections 61B of the first holder 61 and the pair of right and left second mounting sections 62B of the second holders 62 each include: positioning pin insertion holes (the positioning pin insertion holes 61BA and the positioning pin insertion holes 62BA) corresponding to the positioning pin 14A of the lens holder mounting section 14 of the heat sink 10; and screw insertion holes (the screw insertion holes 61BB and the screw insertion holes 62BB) which are provided, as a pair, vertically above and below the positioning pin insertion holes (the positioning pin insertion holes 61BA and the positioning pin insertion holes 62BA) and correspond to the screw fixing holes 14B of the lens holder mounting section 14 of the heat sink 10.

Therefore, the lens holder 60 can be attached to the lens holder mounting section 14 of the heat sink 10 with the screws 14N1 in such a manner that the flange section 72 of the lens 70 is sandwiched by the first holder 61 and the second holder 62.

(Lens 70)

As illustrated in FIGS. 3 and 4, the lens 70 includes the lens section 71 that performs light distribution control and the flange section 72 that is provided integrally with the outer periphery of the lens section 71, and as described above, that is sandwiched by the lens holder 60 (the receiving section 61AA of the first holder 61 and the pressing section 62AA of the second holder 62).

In addition, the flange section 72 is provided with a pair of right and left outwardly opened notched positioning recesses 72A that receive the pair of right and left positioning protrusions 61AB provided on the receiving section 61AA of the first holder 61.

Then, the light from the first light source L and the second light source H is incident on the lens 70 from the incident surface 71A where the light is incident, and the incident light is irradiated to the front side from the light emission surface 71B from which the light is emitted.

Here, as illustrated in FIG. 3, the second light source arrangement section 13A of the second base section 13 is directed forward and obliquely upward, and the second light source H is thereby also directed forward and obliquely upward. Then, by setting this forward and obliquely upward inclination to be appropriate, the high-beam additional light distribution HAP formed by the light from the second light source H (the second light emitting chips H2) is in a state of being hardly separated from the low-beam light distribution pattern LP formed by light from the first light source L (the first light emitting chip L2).

For this reason, if the lens 70, mainly its entire curvature of the light emission surface 71B below a lens optical axis O of the lens 70 (more specifically, the lens section 71), is slightly corrected in such a manner that the low-beam light distribution pattern formed by the light from the first light source L is located slightly above (for example, a few tenths of degrees), the low-beam light distribution pattern and the high-beam additional light distribution are not separated.

As described above, in this embodiment, unlike the case of Patent Literature 1, it is not necessary to partially correct a large radius of curvature, and only a slight correction of the light emission surface 71B of the lens 70 is required, and thus it is possible to suppress the appearance of distortion on the light emission surface 71B of the lens 70.

In this embodiment, while the light emission surface 71B of the lens 70 is slightly corrected, the incident surface 71A of the lens 70 may be slightly corrected, and both the light emission surface 71B and the incident surface 71A may be slightly corrected.

Then, as described below, by arranging such a lens 70 at an appropriate position, it is possible to obtain a good low-beam light distribution pattern LP and a good high-beam light distribution pattern HP.

Figure 6:
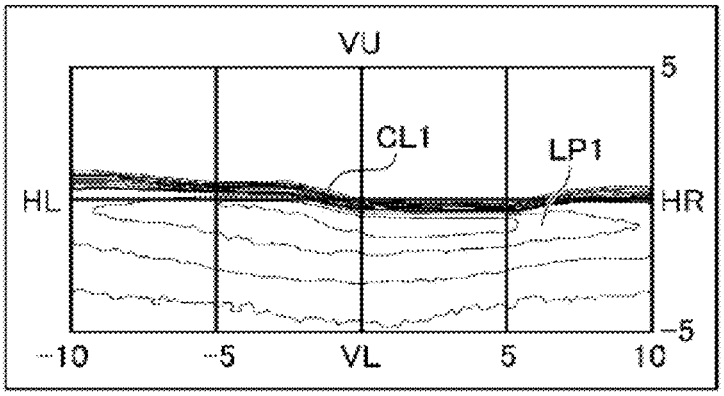
FIG. 6 are graphs illustrating a light distribution pattern on a screen when the lens of the embodiment according to the present invention is arranged in a general arrangement state.
Figure 6:
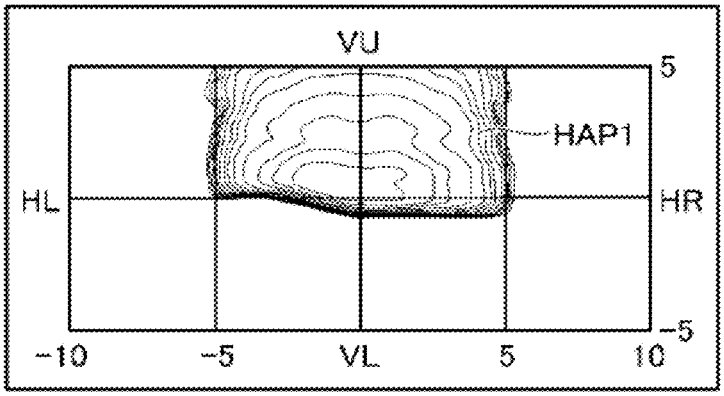
Figure 6:
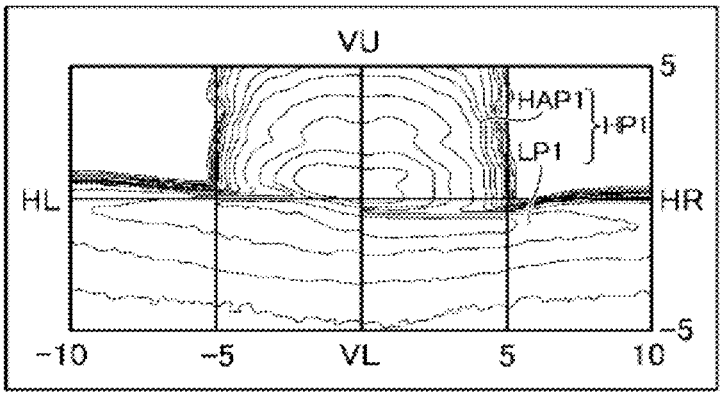

FIG. 6 are graphs illustrating a light distribution pattern on a screen when the lens 70 (more specifically, the lens section 71) is arranged in a general arrangement state. The HL-HR line in the graph indicates the reference horizontal line on the screen, and the VU-VL line indicates the reference vertical line on the screen, and also in the following graphs that illustrate a light distribution pattern on the screen, the HL-HR line indicates the reference horizontal line on the screen, and the VU-VL line indicates the reference vertical line on the screen.

Specifically, FIG. 6 are graphs illustrating a light distribution pattern when the lens 70 is arranged in such a manner that the rear focal point P of the lens 70 illustrated in FIG. 3 (more specifically, the lens section 71) is on the lamp optical axis Z and is located at the second focal point BP which is a focal point on a front side of the reflector 30, and the lens optical axis O of the lens 70 illustrated in FIG. 3 (more specifically, the lens section 71) coincides with the lamp optical axis Z. Since this arrangement is not an actual arrangement, this state is called a virtual state, and the light distribution pattern and the like in this virtual state may also be referred to as with a description of 'virtual'.

Specifically, FIG. 6(A) illustrates a virtual light distribution pattern on the screen when only the first light source L is turned on (that is, a virtual low-beam light distribution pattern LP1 having a virtual cut-off line CL1).

FIG. 6(A) does not illustrate the entire horizontal (right-left direction) range of the virtual low-beam light distribution pattern LP1, but illustrates only the range from approximately 10 degrees to the left (indicated as "−10") to approximately 10 degrees to the right (indicated as "10") from the reference vertical line, and thus illustrates a part of the virtual low-beam light distribution pattern LP1 on the center side.

Similarly, FIG. 6(A) illustrates only the range from approximately 5 degrees above (indicated as "5") to below approximately 5 degrees (indicated as "−5") from the reference horizontal line. In each of the following graphs illustrating the light distribution patterns on the screen, only the light distribution pattern in the same range as in FIG. 6(A) is illustrated, and also in a graph illustrating any pattern, the light distribution pattern is indicated by an isophotal contour.

In addition, FIG. 6(B) illustrates a virtual light distribution pattern on the screen when three second light emitting chips H2 located on the right and left central sides of the second light source H are turned on. That is, a state where three virtual high-beam additional light distributions HAP1 on the center side formed by the three second light emitting chips H2, among a plurality of virtual high-beam additional light distributions HAP1 formed by the plurality of second light emitting chips H2, are multiplexed and illustrated.

Furthermore, FIG. 6(C) is a graph illustrating a virtual high-beam light distribution pattern HP1 in which the virtual light distribution pattern of FIG. 6(A) and the virtual light distribution pattern of FIG. 6(B) are multiplexed. When there is no preceding vehicle or oncoming vehicle, all of the plurality of second light emitting chips H2 are turned on, and thus the virtual high-beam additional light distributions HAP1 formed by the light from each second light emitting chip H2 are further arranged in the horizontal direction while partially overlapping, and the light is irradiated to a wider area in the horizontal direction than an area illustrated in FIG. 6(B).

As can be seen from FIG. 6(C), there is a good virtual high-beam light distribution pattern HP1 having no separated portion between the virtual low-beam light distribution pattern LP1 and the virtual high-beam additional light distribution HAP1. However, in this state, a bright streak with high luminosity may appear between the virtual low-beam light distribution pattern LP1 and the virtual high-beam additional light distribution HAP1.

Consequently, the lens 70 is moved in parallel to the front side in such a manner that the rear focal point P of the lens 70 (more specifically, the lens section 71) is located more to the front side than the second focal point BP which is a focal point on the front side of the reflector 30.

In this embodiment, the rear focal point P of the lens 70 (more specifically, the lens section 71) is located approximately 0.7 mm more to the front side than the second focal point BP of the reflector 30. In this state, the rear focal point P of the lens 70 (more specifically, the lens section 71) is within a range overlapping with the shade 40 when viewed in the front-rear direction and is located below the shade 40.

Figure 7:
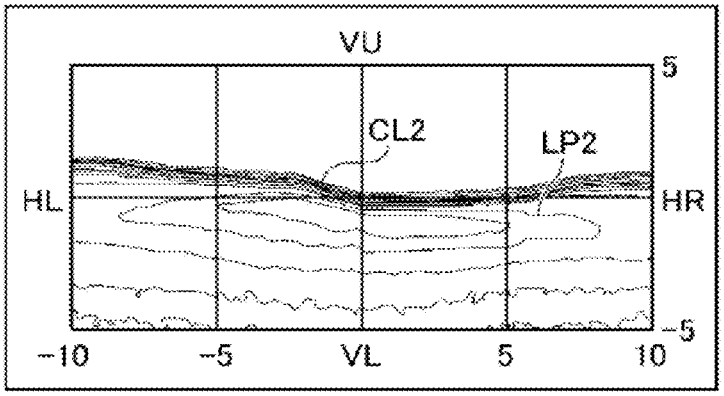
FIG. 7 are graphs illustrating a light distribution pattern when the lens is arranged in such a manner that a rear focal point of the lens of the embodiment according to the present invention is located more to the front side than a second focal point which is a focal point on the front side of a reflector.
Figure 7:
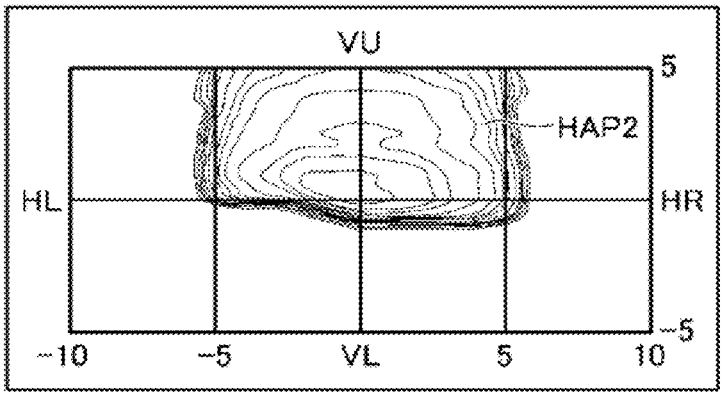
Figure 7:
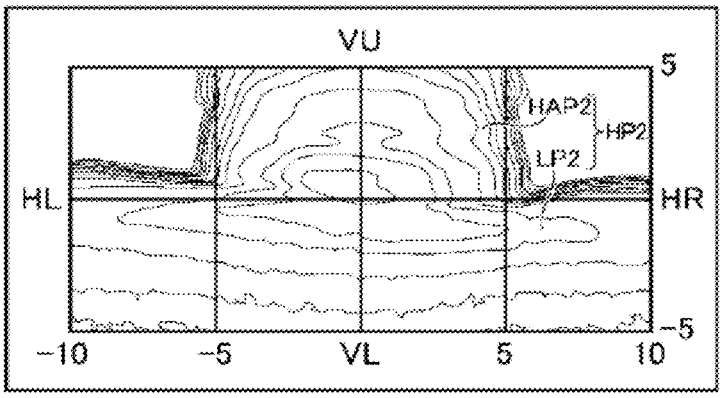

FIG. 7 are graphs illustrating a light distribution pattern when the lens 70 is arranged in such a manner that the rear focal point P of the lens 70 (more specifically, the lens section 71) is located more to the front side than the second focal point BP which is a focal point on the front side of the reflector 30. Also in FIG. 7, similarly to FIG. 6, the lens optical axis O of the lens 70 (more specifically, the lens section 71) illustrated in FIG. 3 coincides with the lamp optical axis Z. FIGS. 7(A) to 7(C) illustrate a light distribution pattern corresponding to FIGS. 6(A) to 6(C).

As described above, when the lens 70 is located on the front side, as illustrated in FIGS. 7(A) and 7(B), the virtual low-beam light distribution pattern LP1 (see FIG. 6(A)) is enlarged as a whole and becomes a low-beam light distribution pattern LP2 (see FIG. 7(A)) with blurring around the light distribution pattern, and the virtual high-beam additional light distribution HAP1 (see FIG. 6(B)) is enlarged as a whole and becomes a high-beam additional light distribution HAP2 with blurring around the light distribution pattern.

Then, when these (the low-beam light distribution pattern LP2 and the high-beam additional light distribution HAP2) are multiplexed, a high-beam light distribution pattern HP2 illustrated in FIG. 7(C) is obtained, and a bright streak with high luminosity hardly appears between the low-beam light distribution pattern LP2 and the high-beam additional light distribution HAP2.

Meanwhile, as described above, since the lens 70 (lens section 71) is set to lift the entire low-beam light distribution pattern, in the state illustrated in FIG. 6, the lens 70 (lens section 71) performs light distribution control in which the virtual cut-off line CL1 of the virtual low-beam light distribution pattern LP1 is located above the cut-off line of the low-beam light distribution pattern originally used as a vehicle lamp.

In addition, as the lens 70 (lens section 71) is moved in parallel from the virtual state to the front side, the virtual low-beam light distribution pattern LP1 (see FIG. 6(A)) becomes the low-beam light distribution pattern LP2 (see FIG. 7(A)) enlarged as a whole, and thus a cut-off line CL2 (see FIG. 7) is further located above the cut-off line of the low-beam light distribution pattern originally used as a vehicle lamp.

Consequently, as illustrated in FIG. 3, the lens optical axis O of the lens 70 is rotated downward with the use of the rear focal point P of the lens 70 (lens section 71) as a rotation axis, and on the condition that the lens optical axis O has an inclination with the rear focal point P as the rotation axis, the lens optical axis O is brought to a state of being inclined forward and obliquely downward with respect to the lamp optical axis Z, and thus the light irradiated from the lens 70 to the front side shifts downward as a whole.

FIG. 8 are graphs illustrating a light distribution pattern when the lens optical axis O of the lens 70 is rotated downward with the use of the rear focal point P of the lens 70 (lens section 71) as a rotation axis.

FIGS. 8(A) to 8(C) illustrate light distribution patterns corresponding to FIGS. 7(A) to 7(C), and specifically are graphs illustrating the light distribution patterns when the lens optical axis O is inclined forward and obliquely downward by approximately 0.4 degrees with respect to the lamp optical axis Z, with the rear focal point P of the lens 70 (lens section 71) as the rotation axis.

Since the lens optical axis O is only inclined forward and obliquely downward by approximately 0.4 degrees, as can be seen by comparing FIG. 7(A) with FIG. 8(A), FIG. 7(B) with FIG. 8(B), and FIG. 7(C) with FIG. 8(C), the overall shape of the light distribution pattern is hardly changed, and the light distribution pattern is in a state of being shifted downward as a whole. While maintaining the overall shape of the low-beam light distribution pattern LP2 (see FIG. 7(A)), the low-beam light distribution pattern LP (see FIG. 8(A)) having a cut-off line CL (see FIG. 8(A)) at an appropriate position can be obtained.

In this embodiment, by the setting of the flange section 72 of the lens 70 to be sandwiched by the lens holder 60, the rear focal point P of the lens 70 (more specifically, the lens section 71) is located approximately 0.7 mm more to the front side than the second focal point BP which is a focal point on the front side of the reflector 30, and the lens optical axis O is inclined forward and obliquely downward by approximately 0.4 degrees with respect to the lamp optical axis Z.

However, the present invention need not be limited to the setting of the flange section 72 of the lens 70, and for example, by the setting in the lens holder 60 side, the rear focal point P of the lens 70 (more specifically, the lens section 71) may be located approximately 0.7 mm more to the front side than the second focal point BP which is a focal point on the front side of the reflector 30, and the lens optical axis O may be inclined forward and obliquely downward by approximately 0.4 degrees with respect to the lamp optical axis Z.

In addition, by the settings of both of the flange section 72 of the lens 70 and the lens holder 60, the rear focal point P of the lens 70 (more specifically, the lens section 71) may be located approximately 0.7 mm more to the front side than the second focal point BP which is a focal point on the front side of the reflector 30, and the lens optical axis O may be inclined forward and obliquely downward by approximately 0.4 degrees with respect to the lamp optical axis Z.

Furthermore, at least one of the incident surface 71A and the light emission surface 71B of the lens 70 may be set to have a shape by which the lens optical axis O is inclined forward and obliquely downward with respect to the lamp optical axis Z.

As described above, the present invention has been described on the basis of the specific embodiment, but the present invention is not limited to the above embodiment.

For example, a light diffusion structure in which fine asperities are formed on the surface (the entire surface in the range where light enters) of the incident surface 71A of the lens 70 (lens section 71) may be provided. By providing such a light diffusion structure, it is possible to further suppress the appearance of a bright streak with high luminosity between the low-beam light distribution pattern LP (see FIG. 8) and the high-beam additional light distribution HAP (see FIG. 8).

Figure 9:
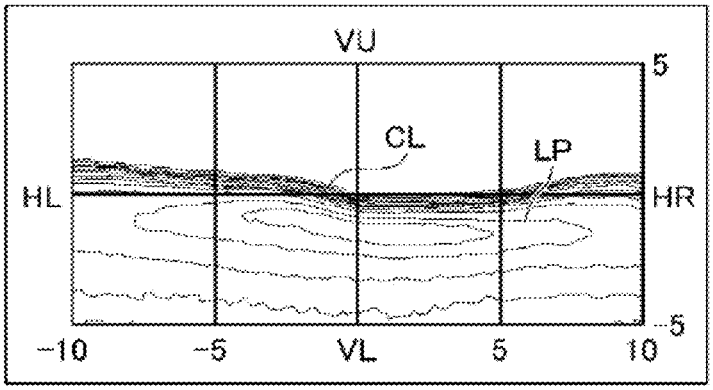
FIG. 9 are graphs illustrating a light distribution pattern when a light diffusion structure is provided on the incident surface of the lens of the embodiment according to the present invention.
Figure 9:
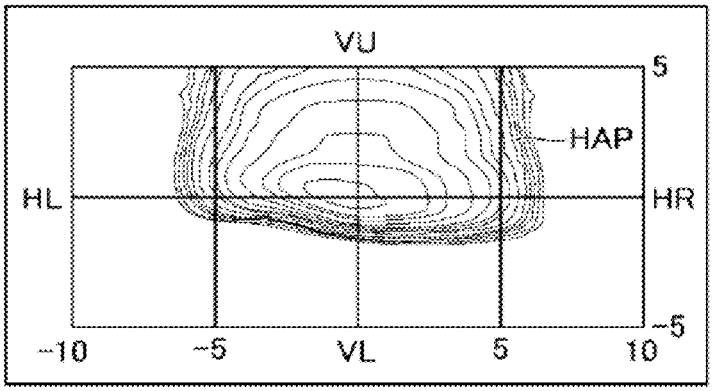
Figure 9:
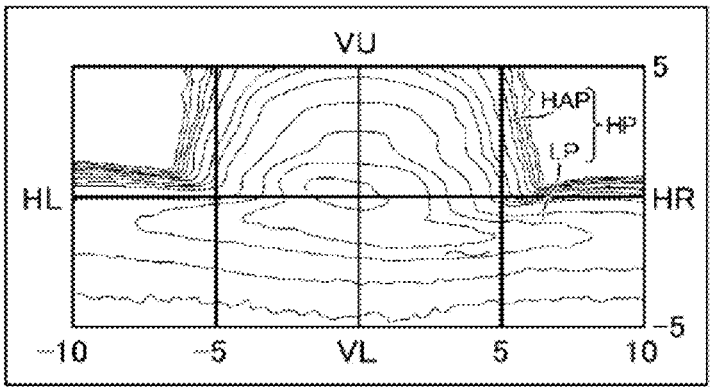

FIG. 9 are graphs illustrating a light distribution pattern when a light diffusion structure is provided on the incident surface 71A of the lens 70. FIGS. 9(A) to 9(C) illustrate light distribution patterns corresponding to FIGS. 8(A) to 8(C).

When comparing FIG. 9(A) with FIG. 8(A), FIG. 9(B) with FIG. 8(B), and FIG. 9(C) with FIG. 8(C), the light distribution pattern illustrated in FIG. 9 is slightly wider, this widened part has only low luminosity in terms of luminosity, and is broadened by the blurring of the light-dark boundary, and thus does not substantially affect the cut-off line CL or the like, and the visibility is further improved by the blurring the light-dark boundary.

As described above, the present invention is not limited to the specific embodiment, but the modifications and improvements that do not depart from the technical idea are also included in the technical scope of the invention, which is apparent to those skilled in the art from the description of the claims.

REFERENCE SIGNS LIST

1 lamp unit
10 heat sink
11 base section
11A opening
11F heat dissipation fin
12 first base section
12A first light source arrangement section
12B positioning pin
12C screw fixing hole
12F first heat dissipation fin
12N1, 12N2 screw
13 second base section
13A second light source arrangement section
13AA positioning pin
13AB screw fixing hole
13F second heat dissipation fin
13N1 screw
14 lens holder mounting section
14A positioning pin
14B screw fixing hole
14N1 screw
15 cooling fan mounting leg
15N1 screw
20 cooling fan
30 reflector
30A reflection section
30B flange section
30BA pin insertion hole
30BB screw insertion hole
31 reflection surface
40 shade
41 light shielding section
42 arm section
42A positioning pin insertion hole
42B screw insertion hole
50 reflection member
51 reflection section
52 fixing section
52A positioning pin insertion hole
52B screw insertion hole
60 lens holder
61 first holder
61A first holder main body
61AA receiving section
61AB positioning protrusion
61B first mounting section
61BA positioning pin insertion hole
61BB screw insertion hole
62 second holder
62A second holder main body
62AA pressing section
62B second mounting section
62BA positioning pin insertion hole
62BB screw insertion hole
70 lens
71 lens section
71A incident surface
71B light emission surface
72 flange section
72A positioning recess
80 light source holder
90 plate member
BP second focal point
H second light source
H1 substrate
H11 positioning pin insertion hole
H12 screw insertion hole
H2 second light emitting chip
L first light source
L1 substrate
L2 first light emitting chip
O lens optical axis
P rear focal point
Z lamp optical axis
101L, 101R vehicle head lamp
102 vehicle

The invention claimed is:

1. A vehicle lamp comprising:
a first light source that emits light for low-beam light distribution;
a lens arranged in a front side of the first light source;
a shade that is arranged between the first light source and the lens and forms a cut-off line of a low-beam light distribution pattern;
a reflector that reflects light from the first light source towards the lens; and
a second light source that is arranged between the first light source and the lens and emits light for high-beam additional light distribution,
wherein a rear focal point of the lens is located more to a front side than a second focal point of the reflector which is on a front side of the first light source, and a lens optical axis of the lens is inclined forward and obliquely downward with respect to a lamp optical axis of the lamp on which the rear focal point and the second focal point are located.

2. The vehicle lamp according to claim 1, wherein in a virtual state where the lens is provided in such a manner that the lens optical axis coincides with the lamp optical axis, the lens performs light distribution control by which a virtual cut-off line of a virtual light distribution pattern formed by the light from the first light source is located above the cut-off line of the low-beam light distribution pattern.

3. The vehicle lamp according to claim 1, wherein an inclination of the lens optical axis is such that the lens optical axis is rotated and inclined with the rear focal point of the lens as a rotation axis.

4. The vehicle lamp according to claim 1, comprising:
a heat sink; and
a lens holder that attaches the lens to the heat sink,
wherein the heat sink includes:
a first base section on which the first light source is arranged; and a second base section which is located on a front side of the first base section and is inclined forward and obliquely downward, and on which the second light source is arranged, wherein the second light source includes a plurality of second light emitting chips that are arranged in a horizontal direction, and wherein the shade includes:

a light shielding section that is located above the second light emitting chips and forms the cut-off line of the low-beam light distribution pattern; and a pair of arm sections provided at both ends of the light shielding section and fixed to the heat sink.

5. The vehicle lamp according to claim 4, comprising a reflection member that is arranged below the second light emitting chips and reflects, toward the lens, light from the second light source, and that is a member separate from the shade.

6. The vehicle lamp according to claim 4, wherein the lens includes a flange section fixed to the lens holder, and wherein at least one of the lens holder and the flange section is configured to incline the lens optical axis forward and obliquely downward with respect to the lamp optical axis.

7. The vehicle lamp according to claim 1, wherein at least one of an incident surface and a light emission surface of the lens is configured to have a shape to incline the lens optical axis forward and obliquely downward with respect to the lamp optical axis.

* * * * *